US005151061A

United States Patent [19]

Sandhu

[11] Patent Number: 5,151,061

[45] Date of Patent: Sep. 29, 1992

[54] METHOD TO FORM SELF-ALIGNED TIPS FOR FLAT PANEL DISPLAYS

[75] Inventor: Gurtej S. Sandhu, Boise, Id.

[73] Assignee: Micron Technology, Inc., Boise, Id.

[21] Appl. No.: 839,606

[22] Filed: Feb. 21, 1992

[51] Int. Cl.[5] ..... H01J 9/02

[52] U.S. Cl. ..... 445/24; 445/50; 313/309

[58] Field of Search ..... 445/24, 50, 52; 313/309, 336, 351

[56] References Cited

U.S. PATENT DOCUMENTS

| | | | |
|---|---|---|---|
| 4,498,952 | 2/1985 | Christensen | 445/51 X |
| 4,874,981 | 10/1989 | Spindt | 445/24 X |
| 4,923,421 | 5/1990 | Brodie et al. | 445/24 |
| 5,100,355 | 3/1992 | Marcus et al. | 445/24 |

OTHER PUBLICATIONS

"Fabrication of Silicon Field Emission Points for Vacuum Microelectronics by Wet Chemical Etching", by Johann T. Trujillo et al., Semicond. Sci. Technol. 6 (1991), pp. 223–225.

"Oxidation Sharpening of Silicon Tips", by T. S. Ravi et al., J. Vac. Sci. Technol. B 9 (6), Nov./Dec. 1991.

*Primary Examiner*—Kenneth J. Ramsey
*Attorney, Agent, or Firm*—David J. Paul

[57] ABSTRACT

The present invention develops a process wherein a method for fabrication of field emission tips for flat panel displays and in particular to the formation of an array of self-aligned emission cathode tips. The method forms self-aligned ultra-sharp cathode tips out of a conducting material by etching contacts into an insulator which encloses a grid of conducting lines which will serve as the anodes. Next, a film having poor step coverage is deposited into the contacts followed by a selective deposition of a conducting material thereby resulting in a cone shaped configuration. Then the film is etched selective to the cone followed by the sharpening of the cone tip by conventional methods, thereby resulting in an array of evenly-spaced self-aligned emission cathodes having ultra-sharp tips.

42 Claims, 3 Drawing Sheets

METHOD TO FORM SELF-ALIGNED TIPS FOR FLAT PANEL DISPLAYS

FIELD OF THE INVENTION

This invention relates to a method for fabrication of field emission tips for flat panel displays and in particular to the formation of an array of self-aligned emission cathode tips.

BACKGROUND OF THE INVENTION

Flat panel displays have been developed and used in recent years as a display mechanism to rival the conventional cathode ray tube displays. Portable systems have benefitted from the use of flat panel displays as less space is required which allows for a lighter more compact system along with the fact the flat panel displays consume less power.

One type of flat panel display is the field emission cathode type wherein the electron emitting cathode is separated from the display face (or anode) at a relatively small and ideally uniform distance by an insulator. The insulation must be minimal and the number of cathodes high in order to obtain a display possessing the desirable features of high resolution and brightness.

As previously mentioned, a high number of cathodes is desirable in that better resolution is obtained. At the same time, if the spacing between cathode tips is uniform, the brightness will be uniform throughout the display. Unfortunately, as the number of tips increase, uniform spacing becomes increasingly difficult.

In U.S. Pat. No. 4,923,421, Brodie et al., a method for providing polyimide spacers in a field emission panel display is disclosed. In Brodie, the process comprises forming a insulating layer of polyimide material having uniform thickness over either the emission cathode or over the opposing display face in order to obtain a uniform distance between the two. Brodie, intentionally sandwiches the cathode and display face together in order to avoid the need of uniform spacing between the cathode and display face during fabrication.

In an article entitled "FABRICATION OF SILICON FIELD EMISSION POINTS FOR VACUUM MICROELECTRONICS BY WET CHEMICAL ETCHING", Semicond. Sci. Technology, Vol 6 (1991), pp 223-225, by Trujillo et al., various etching methods to sharpen field emission points are discussed. The main focus of this article is to fabricate the sharpest silicon emission tips possible in order to maximize field emission of electrons from cathode to the flat plane anode.

Also, in a technical article entitled "OXIDATION SHARPENING OF SILICON TIPS," J. Vac. Sci. Technol. B 9 (6), Nov./Dec. 1991, pp 2733-2737, by T.S. Ravi et al., a study describes unified etching/oxidation treatment that results in uniform tips with controlled radii of atomic dimensions. Variations in the etching/oxidation treatment cause multiple tips to form as discussed in this article.

These publications, however, fail to address the problem of how to maintain an array of evenly spaced-apart, self-aligned, cathode tips using conventional fabrication techniques.

The present invention, however, specifically teaches a simpler method to form self-aligned cathode emission tips as will be described.

SUMMARY OF THE INVENTION

The invention is directed to a method for fabrication of field emission tips for flat panel displays and in particular to the formation of an array of self-aligned emission cathode tips.

The method forms self-aligned ultra-sharp cathode tips out of a conducting material by etching contacts into an insulator which encloses a grid of conducting lines which will serve as the anodes. Next, a film having poor step coverage is deposited into the contacts followed by a selective deposition of a conducting material thereby resulting in a cone shaped configuration. Then the film is etched selective to the cone shape which is followed by the sharpening of the cone tip by conventional methods, thereby resulting in an array of evenly-spaced, self-aligned, emission cathodes having ultra-sharp tips.

The present invention is described in light of a CMOS fabrication process to develop self-aligned emission tips for flat panel displays, however it will be evident to one skilled in the art to incorporate these steps into other processes that may benefit from self-aligned field emission tip fabrication.

DETAILED DESCRIPTION OF THE PREFERRED EMBODIMENT

The present invention is directed to fabricating self-aligned cone shaped emission tips in a process depicted in FIGS. 1–5, to develop flat panel displays.

Figure 1:
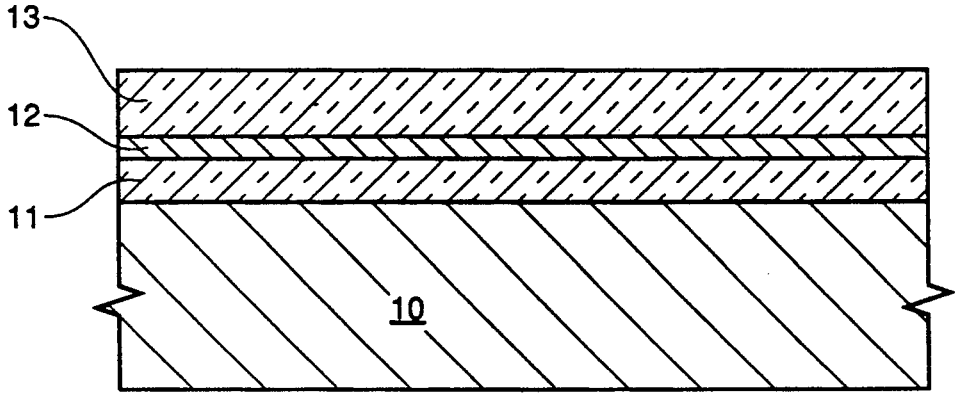
FIG. 1 is a cross-sectional view of an in-process wafer portion after deposition of a first dielectric film, definition of a metal grid followed by deposition of a second dielectric film.

Referring now to FIG. 1, starting substrate 10 (usually silicon) is covered with a blanket deposition of dielectric 11. Next, a metal grid 12 is formed that intersects at spaced-apart points that will eventually define the size of the display panel emission array and also serve as the anode terminals for the display panel. Grid 12 could also be conductively doped polysilicon if so desired. Then, grid 12 is covered with a blanket deposition of dielectric 13.

Figure 2A:
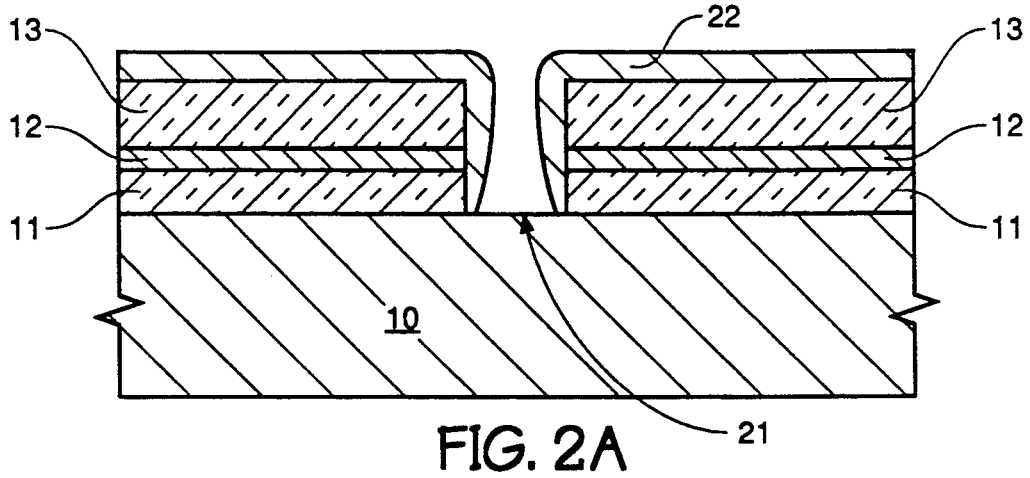
FIGS. 2*a* and 2*b* are cross-sectional views of the in-process wafer portion of FIG. 1 following contact etching and deposition of a third dielectric film, respectively.
Figure 2B:
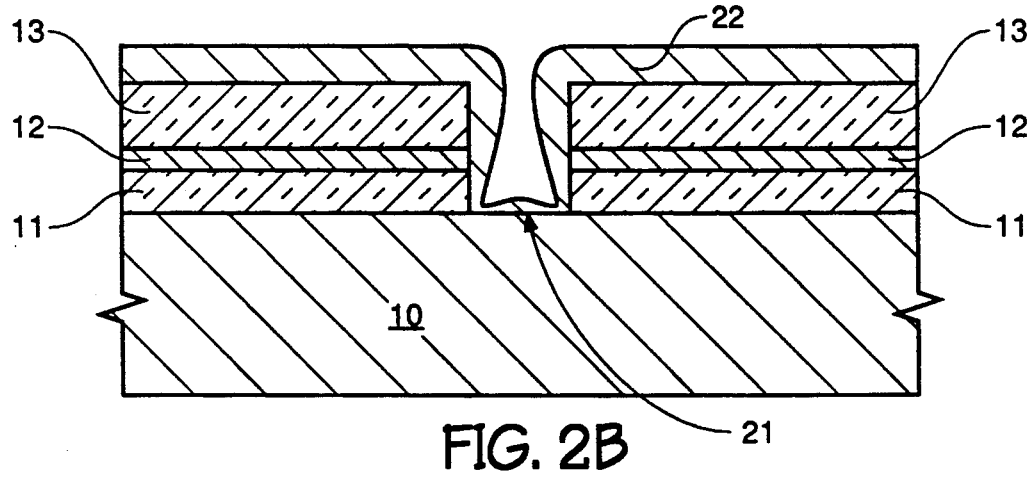
Figure 2C:
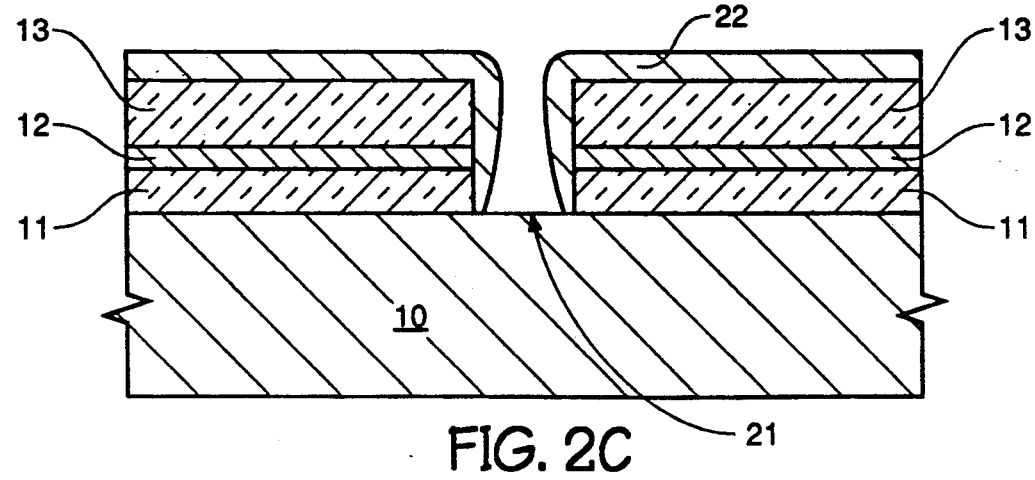
FIG. 2*c* is a cross-sectional views of the in-process wafer portion of FIG. 2*b* following etching of said third dielectric film to expose the underlying substrate.

Referring now to FIG. 2*a*, using standard mask alignment methods common in semiconductor processing, at each intersection formed in metal grid 12, contacts 21 are opened to expose underlying portions of substrate 10. Next, film 22 with poor step coverage is deposited.

Examples of films having a poor step coverage are ones deposited by sputtering, or a CVD deposited TEOS or as deposited by plasma CVD to name the common ones. So in fact film 22 need not be a dielectric at all since it will be completely removed in a subsequent etch step.

Alternately, as shown in FIGS. *2b* and *2c* a thin layer of film 22 possessing poor step coverage is deposited followed by an etch (either isotropic or anisotropic) that will clear substrate 10.

Figure 3:
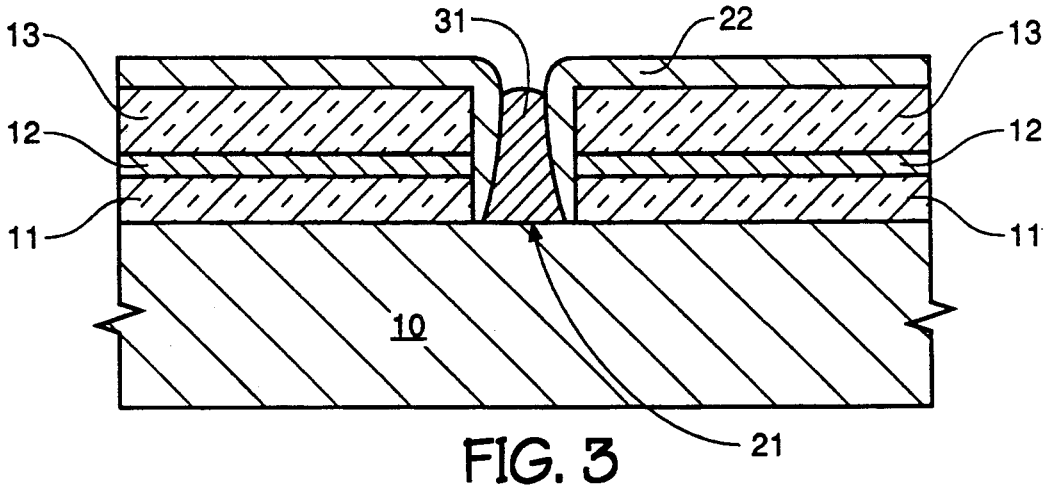
FIG. 3 is a cross-sectional view of the in-process wafer portion of FIGS. 2*a* and 2*c* following a deposition of a selective metal.

Regardless of the steps used to prepare film 22, as shown in FIG. 3, a selective deposition of metal 31 (or doped polysilicon) is used to fill the void caused by the poor step coverage of film 22 and thereby connects to substrate 21. Since the substrate silicon 21 is exposed it would also be possible to use selectively grown epitaxial silicon (single crystal) to fill the void by using substrate 21 as a source if so desired.

Figure 4:
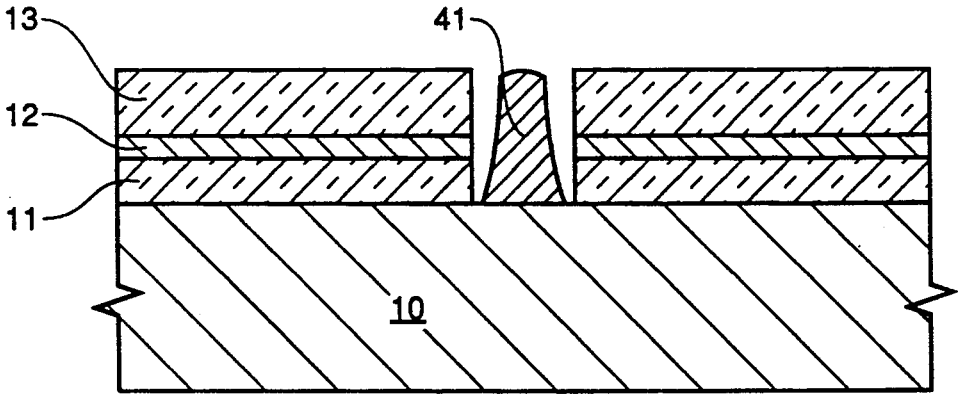
FIG. 4 is a cross-sectional view of the in-process wafer portion of FIG. 3 following a wet etch to remove the third dielectric film thereby leaving a self-aligned cone tip.

Referring now to FIG. 4, dielectric 22 (seen in either FIG. *2a* or *2b*) has been selectively etched away using a wet etch thereby forming a cone shaped structure 41. Structure 31 is self-aligned in contact 21 opening due to prior presence of dielectric 22 and will serve as the self-aligned emission cathodes developed in the present invention. It is conceivable, although not preferred, that a conformal layer of polysilicon could be deposited in place of the selective deposition of metal 31 and then etched back to form the cone shaped structures 41.

Figure 5:
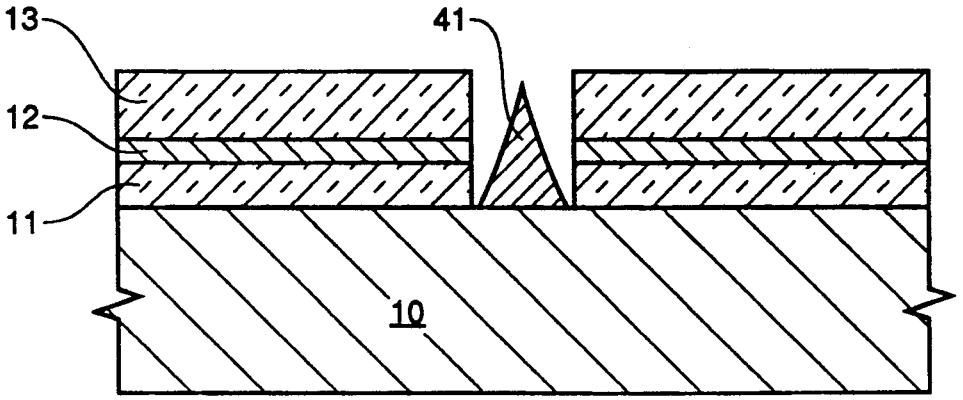
FIG. 5 is a cross-sectional view of the in-process wafer portion of FIG. 4 following cone tip sharpening by oxidation or by other tip sharpening schemes known to those skilled in the art.

Finally, as shown in FIG. 5, the tip of structure 41 5 is sharpened by oxidation and wet etch methods know in the art and the display panel emission array is then completed by conventional fabrication techniques know to those skilled in the art.

Although the present invention has bee described with reference to a preferred embodiment, various modifications, known to those skilled in the art, may be made to the process steps presented herein without departing from the invention as recited in the several claims appended hereto.

I claim:

1. A process for forming conductive self-aligned emission cathode tips on a starting substrate for use in flat panel displays, said process comprising the steps of:

a) forming a first dielectric layer superjacent and coextensive said starting substrate;

b) placing and patterning a first conductive layer superjacent and coextensive said first dielectric layer, said patterning of said first conductive layer resulting in a conductive grid structure having a plurality of a first set of parallel conductive lines in intersection with a plurality of a second set of parallel conductive lines and a plurality of exposed portions of said first dielectric layer;

c) forming a second dielectric layer superjacent and coextensive said conductive grid structure and exposed portions of said first dielectric layer;

d) etching a buried contact opening at each grid intersection thereby exposing portions of said starting substrate, and forming patterned edges in each layer bordering each said contact opening;

e) forming a sacrificial layer superjacent and coextensive said second dielectric layer and the patterned edges of said second dielectric layer, said first conductive layer and said first dielectric layer thereby forming cone-shaped voids at said exposed portions of said starting substrate;

f) placing a second conductive layer into said cone-shaped voids thereby connecting to said exposed portions of said starting substrate;

g) removing said sacrificial layer thereby forming said self-aligned cathode emission tips; and h) sharpening said emission tips.

2. A process as recited in claim 1, wherein said starting substrate is silicon.

3. A process as recited in claim 1, wherein said second conductive layer is selectively deposited.

4. A process as recited in claim 1, wherein an additional step between steps "e" and "f" comprises etching said sacrificial layer thereby removing any film residue of said sacrificial layer present over said exposed portions of said starting substrate.

5. A process as recited in claim 4 wherein said etch is an isotropic etch.

6. A process as recited in claim 4 wherein said etch is an anisotropic etch.

7. A process as recited in claim 1, wherein said placing of said second conductive layer into said cone-shaped voids comprises the steps of:

a) forming a blanket layer of said second conductive layer; and b) etching said blanket layer thereby leaving only said second conductive layer residing inside said cone-shaped void.

8. A process as recited in claim 1, wherein said first and said second conductive layers are metal.

9. A process as recited in claim 1, wherein said first and said second conductive layers are doped polysilicon.

10. A process as recited in claim 1, wherein said first conductive layer is metal and said second conductive layer is conductively dope polysilicon.

11. A process as recited in claim 1, wherein said first conductive layer is conductively doped polysilicon and said second conductive layer is metal.

12. A process as recited in claim 1, wherein said second conductive layer is single crystalline silicon formed by epitaxial growth.

13. A process as recited in claim 1, wherein said forming of said sacrificial layer results in a step coverage such that said sacrificial layer does not coat said exposed substrate and instead forms sacrificial film buildup at the top of said patterned edges while tapering inward and thereby becoming thinner at the bottom of said patterned edges.

14. A process as recited in claim 13, wherein said sacrificial layer comprises a dielectric layer.

15. A process as recited in claim 1, wherein said forming said sacrificial layer is a process selected from the group consisting essentially of film sputtering, plasma CVD and CVD TEOS

16. A process for forming conductive self-aligned emission cathode tips on a starting substrate for use in flat panel displays, said process comprising the steps of:

a) forming a first dielectric layer superjacent and coextensive said starting substrate;

b) placing and patterning a first conductive layer, superjacent and coextensive said first dielectric layer, said patterning of said first conductive layer resulting in a conductive grid structure having a plurality of a first set of parallel conductive lines in intersection with a plurality of second set of parallel conductive lines and a plurality of exposed portions of said first dielectric layer;

c) forming a second dielectric layer superjacent and coextensive said conductive grid structure and exposed portions of said first dielectric layer;

d) etching a buried contact opening at each grid intersection thereby exposing portions of said starting substrate;

e) forming a sacrificial layer superjacent and coextensive said second dielectric layer and the patterned edges of said second dielectric layer, said first conductive layer and said first dielectric layer thereby forming cone-shaped voids at said exposed portions of said starting substrate;

f) placing a second conductive layer selectively into said cone-shaped voids thereby connecting to said exposed portions of said starting substrate;

g) removing said sacrificial layer thereby forming said self-aligned cathode emission tips; and h) sharpening said emission tips

17. A process as recited in claim 16, wherein said starting substrate is silicon.

18. A process as recited in claim 16, wherein said second conductive layer is selectively deposited.

19. A process as recited in claim 16, wherein an additional step between steps "e" and "f" comprises etching said sacrificial layer thereby removing any film residue of said sacrificial layer present over said exposed portions of said starting substrate.

20. A process a recited in claim 19 wherein said etch is an isotropic etch.

21. A process as recited in claim 19 wherein said etch is an anisotropic etch.

22. A process as recited in claim 16, wherein said second conductive layer is single crystalline silicon formed by epitaxial growth.

23. A process as recited in claim 16, wherein said first and said second conductive layers are metal.

24. A process as recited in claim 16, wherein said first and said second conductive layers are doped polysilicon.

25. A process as recited in claim 16, wherein said first conductive layer is metal and said second conductive layer is conductively doped polysilicon.

26. A process as recited in claim 16, wherein said first conductive layer is conductively doped polysilicon and said second conductive layer is metal.

27. A process as recited in claim 16, wherein said forming of said sacrificial layer results in a step coverage such that said sacrificial layer does not coat said exposed substrate and instead forms sacrificial film buildup at the top of said patterned edges while tapering inward and thereby becoming thinner at the bottom of said patterned edges.

28. A process as recited in claim 27, wherein said sacrificial layer comprises a dielectric layer.

29. A process as recited in claim 16, wherein said forming said sacrificial layer is a process selected from the group consisting essentially of film sputtering, plasma CVD and CVD TEOS.

30. A process for forming conductive self-aligned emission cathode tips on a starting substrate for use in flat panel displays, said process comprising the steps of:

a) forming a first dielectric layer superjacent and coextensive said starting substrate;

b) placing and patterning a first conductive layer superjacent and coextensive said first dielectric layer, said patterning of said first conductive layer resulting in a conductive grid structure having a plurality of a first set of parallel conductive lines in intersection with a plurality of a second set of parallel conductive lines and a plurality of exposed portions of said first dielectric layer;

c) forming a second dielectric layer superjacent and coextensive said conductive grid structure and exposed portions of said first dielectric layer d) etching a buried contact opening at each grid intersection thereby exposing portions of said starting substrate;

e) forming a sacrificial layer superjacent and coextensive said second dielectric layer and the patterned edges of said second dielectric layer, said first conductive layer and said first dielectric layer thereby forming cone-shaped voids at said exposed portions of said starting substrate;

f) placing blanketing second conductive layer superjacent said sacrificial layer and into said cone-shaped voids thereby connecting to said exposed portions of said starting substrate;

g) isotropically etching said second conductive layer thereby exposing said sacrificial layer while leaving said second conductor residing inside said cone-shaped voids;

h) removing said sacrificial layer thereby forming said self-aligned cathode emission tips; and i) sharpening said emission tips.

31. A process as recited in claim 30, wherein an additional step between steps "e" and "f" comprises etching said sacrificial layer thereby removing any film residue of said sacrificial layer present over said exposed portions of said starting substrate.

32. A process as recited in claim 31 wherein said etch is an isotropic etch.

33. A process as recited in claim 31 wherein said etch is an anisotropic etch.

34. A process as recited in claim 30, wherein said second conductive layer is single crystalline silicon formed by epitaxial growth.

35. A process as recited in claim 30, wherein said starting substrate is silicon.

36. A process as recited in claim 30, wherein said first and said second conductive layers are metal.

37. A process as recited in claim 30, wherein said first and said second conductive layers are doped polysilicon.

38. A process as recited in claim 30, wherein said first conductive layer is metal and said second conductive layer is conductively doped polysilicon.

39. A process as recited in claim 30, wherein said first conductive layer is conductively doped polysilicon and said second conductive layer is metal.

40. A process as recited in claim 30, wherein said forming of said sacrificial layer results in a step coverage such that said sacrificial layer does not coat said exposed substrate and instead forms sacrificial film buildup at the top of said patterned edges while tapering inward and thereby becoming thinner at the bottom of said patterned edges.

41. A process as recited in claim 40, wherein said sacrificial layer comprises a dielectric layer.

42. A process as recited in claim 30, wherein said forming said sacrificial layer is a process selected from the group consisting essentially of film sputtering, plasma CVD and CVD TEOS.

* * * * *